US008967130B2

(12) United States Patent
Victor et al.

(10) Patent No.: US 8,967,130 B2
(45) Date of Patent: Mar. 3, 2015

(54) TOY PROJECTILE LAUNCHER APPARATUS

(75) Inventors: Robert James Victor, Sunnyside, NY (US); Brian Jablonski, Providence, RI (US)

(73) Assignee: Hasbro, Inc., Pawtucket, RI (US)

( * ) Notice: Subject to any disclaimer, the term of this patent is extended or adjusted under 35 U.S.C. 154(b) by 606 days.

(21) Appl. No.: 12/890,689

(22) Filed: Sep. 26, 2010

(65) Prior Publication Data

US 2012/0073554 A1 Mar. 29, 2012

(51) Int. Cl.
*F41B 7/08* (2006.01)

(52) U.S. Cl.
USPC ..... 124/36; 124/16; 124/26; 446/473

(58) Field of Classification Search
USPC ..... 124/26, 27, 31, 36, 51.1, 52, 81, 16, 21, 124/42, 43; 446/429, 430, 473, 40, 486, 446/255; 473/509, 511, 588
See application file for complete search history.

(56) References Cited

U.S. PATENT DOCUMENTS

| | | | | |
|---|---|---|---|---|
| 368,307 A | | 8/1887 | Rhodes | |
| 961,511 A | | 6/1910 | Marble | |
| 1,294,917 A | | 2/1919 | Koontz | |
| 1,353,663 A | | 9/1920 | Napier | |
| 1,374,757 A | * | 4/1921 | Napier | 124/26 |
| 2,722,211 A | * | 11/1955 | Eisele | 124/16 |
| 3,430,620 A | | 3/1969 | Davis | |
| 3,635,204 A | | 1/1972 | Plumb, Jr. | |
| 3,717,136 A | * | 2/1973 | Gay | 124/21 |

(Continued)

FOREIGN PATENT DOCUMENTS

FR 2185933 A5 1/1974

OTHER PUBLICATIONS

European Patent Application No. EP 11182731.7—Communication Transmittal, European Opinion, and Search Report dated Sep. 13, 2013.

*Primary Examiner* — Gene Kim
*Assistant Examiner* — John E Simms, Jr
(74) *Attorney, Agent, or Firm* — Perry Hoffman

(57) ABSTRACT

A toy launcher apparatus for discharging circular projectiles, the apparatus having a housing, lower and upper panels mounted to the housing, supports mounted to the housing, a cocking slide and a slide spring connected to the supports, a projectile receptacle connected to the cocking slide, release levers mounted to the housing, a guide wall mounted to the lower panel, a positioning wheel also mounted to the lower panel, and a trigger mounted to the housing. The lower panel includes a slot positioned parallel to the guide wall but off center relative to a center point of a load projectile. Beneath the lower panel is a rotatable launch arm connected to a torsion spring and a catch structure. The upper and lower panels are parallel to one another and spaced to receive a projectile. The projectile is loaded into the projectile receptacle when the receptacle is exposed during the time the launch arm and torsion spring are cocked by a user pulling rearward on the cocking slide. The launch arm is captured by the catch structure, and the cocking slide and the receptacle are also captured. After loading the projectile, the one of the release levers is activated to snap the cocking slide, the carriage and the loaded projectile to a predetermined launch position. When a user pulls the trigger the launch arm is rapidly rotated by the torsion spring through the slot where the launch arm impacts the loaded and correctly positioned projectile and causes the projectile to be discharge with a spin.

20 Claims, 6 Drawing Sheets

(56) References Cited

U.S. PATENT DOCUMENTS

| | | | | | |
|---|---|---|---|---|---|
| 3,779,227 | A | * | 12/1973 | Scott | 124/16 |
| 3,949,731 | A | | 4/1976 | Caso | |
| 3,968,783 | A | | 7/1976 | Pfotenhauer | |
| 4,016,854 | A | * | 4/1977 | Lehman | 124/27 |
| 4,030,472 | A | | 6/1977 | Watkins | |
| 4,059,089 | A | | 11/1977 | Lehman | |
| 4,067,308 | A | | 1/1978 | Andersen et al. | |
| 4,170,215 | A | | 10/1979 | Kettlestrings | |
| 4,248,202 | A | | 2/1981 | Jaworski et al. | |
| 4,270,293 | A | | 6/1981 | Plumer et al. | |
| 4,277,068 | A | * | 7/1981 | Sasaki | 473/511 |
| 4,335,701 | A | | 6/1982 | Bozich | |
| 4,659,320 | A | | 4/1987 | Rich et al. | |
| 5,050,575 | A | | 9/1991 | Killion | |
| 5,224,701 | A | | 7/1993 | Sciarrillo et al. | |
| 5,355,866 | A | | 10/1994 | Hunter | |
| 5,471,967 | A | * | 12/1995 | Matsuzaki et al. | 124/6 |
| 5,529,050 | A | | 6/1996 | D'Andrade | |
| 5,611,322 | A | * | 3/1997 | Matsuzaki et al. | 124/6 |
| 5,613,482 | A | * | 3/1997 | Thai et al. | 124/16 |
| 5,782,228 | A | | 7/1998 | Wu | |
| 5,970,970 | A | | 10/1999 | Vanek et al. | |
| 5,996,564 | A | | 12/1999 | Kotowski | |
| 6,116,229 | A | * | 9/2000 | Wu | 124/6 |
| 6,224,457 | B1 | | 5/2001 | Wu | |
| 6,598,329 | B1 | | 7/2003 | Alexander | |
| 6,733,356 | B2 | | 5/2004 | Lee | |
| 7,287,526 | B1 | | 10/2007 | Bligh et al. | |
| 7,418,797 | B1 | | 9/2008 | Crose | |
| 7,437,847 | B1 | | 10/2008 | Mabry | |
| 7,552,557 | B1 | | 6/2009 | Mabry | |
| 7,673,624 | B2 | * | 3/2010 | Rosella, Jr. | 124/10 |
| 2006/0191520 | A1 | * | 8/2006 | Williamson et al. | 124/5 |
| 2006/0242880 | A1 | | 11/2006 | Griffin | |

* cited by examiner

TOY PROJECTILE LAUNCHER APPARATUS

FIELD OF THE INVENTION

The present invention relates generally to a toy projectile launcher apparatus, and, more particularly, to a toy projectile launcher apparatus that discharges a covered circular disc or toy projectile having a soft exterior and somewhat robust interior with good flight characteristics and distance.

BACKGROUND OF THE INVENTION

Toys and other devices that discharge disc-like objects have been designed in the past with various housing and internal elements. These devices are often difficult to use or dangerous for children, or are too expensive, complicated or insufficiently robust.

Launching devices, toy and otherwise, are well known and are disclosed in several existing patents. By way of example, Napier patented a launching device in 1920 and 1921, U.S. Pat. No. 1,353,663 for a "Target Throwing Device" and U.S. Pat. No. 1,374,757 for a "Catapult." These patents purport to disclose a launching device for clay pigeon targets and include a slanted platform with a guideway in the platform, a guide rail to one side of the platform and a roller for accelerating the clay pigeon. Friction material is added to the guide rail and to the roller to "give it (the missile-clay pigeon) the desired action as it leaves said platform." U.S. Pat. No. 4,016,854 for a "Spring Type Bottle Cap Pistol" issued in early 1977 to Lehman and purports to disclose a pistol to propel and spin a bottle cap by positioning a spring connected to a plunger in a lower longitudinally directed chamber, attaching a hammer to the plunger, the hammer extending through a slot in a upper longitudinally directed chamber where the bottle cap is loaded. The hammer is located off-center from the bottle cap so that when a trigger is rotated, the plunger is released to accelerate the hammer and bottle cap along the upper chamber discharge the bottle cap while also inducing a spin in the cap. A restraining pin extends through a slot to abut an interior surface wall of the bottle cap to prevent the bottle cap from moving along the upper chamber until the trigger is depressed at which time the pin moves out of the way. Loading of a bottle cap is from above the pistol through a sliding cover. Another patent issued to Lehman later in 1977, U.S. Pat. No. 4,059,089 for a "Flying Saucer Launching Pistol" purports to disclose a pistol very similar to that disclosed in his earlier patent but with a pair of ramps in the firing chamber tapered so as to center different diameter discs when each is loaded. U.S. Pat. No. 4,170,215 for a "Disk Toy And Launcher" issued in 1979 to Kettlestrings, purports to disclose a mechanical launcher for a toy disk that has a recess for engaging and bending a leaf spring when loaded. After bending the spring, the disk is received by tabs of catch members in the launcher. When a plunger dislodges the tabs the spring propels the disk away from the launcher.

Another U.S. Pat. No. 4,248,202 for a "Disc Launcher" issued in 1981 to Jaworski and Breslow, and purports to disclose a mechanical launcher having a circular casing, a disc magazine for feeding discs by gravity, an actuating arm movable between a loading position and a firing position, a spring and a rubber band biased trigger. In the loading position the actuating arm receives a soft round disc in front of curved edge portion. A user rotates the actuating arm and the edge portion to a firing position, the actuating arm preventing any more discs falling from the magazine, while moving a free arm of the spring loads the spring. All the while a launching slot is blocked. The user then returns the actuating arm to the loading position. When the user pulls the trigger, the free arm of the loaded spring contacts the outer peripheral portion of the disc to eccentrically propel the disc through the launching slot and away from the launcher.

U.S. Pat. No. 4,659,320 for a "Toy Vehicle With Disc Launching Apparatus And Disks" issued in 1987 to Rich et al, and purports to disclose a toy vehicle carrying an inclined track for storing multiple disks and a spring biased catapult lever. When a user moves the catapult lever to load the spring and then releases the catapult lever, a peripheral edge of the lever engages a spindle of a disk causing the disk to spin and eject from the vehicle. The disk moves away from the vehicle along the surface on which the vehicle is positioned. (It is noted that the spellings used for "disc" and "disk" are adopted from spellings used by the referenced patents, and in the case of U.S. Pat. No. 4,659,320 both spellings are used.) U.S. Pat. Nos. 5,471,967 and 5,611,322 issue to Matsuzaki in 1995 and 1997, respectively, for a "Disc Discharging Toy" purports to disclose motor operated spinning wheels for imparting energy to a discharging disc. U.S. Pat. No. 5,996,564 for a "Disc Discharge Device" issued in 1999 to Kotowski, and purports to disclose a disc-discharging toy having a magazine for stacking resilient discs and a motor driven roller mounted in a position such that the roller's axis of rotation is perpendicular to the axis of rotation of a discharging disc. When the motor is activated and a disc is moved forward to the spinning roller, a bumper places the disc in position to make correct contact between the disc and the roller prior to the disc being discharged. In 2001, U.S. Pat. No. 6,224,457 for a "Knock-down Style Safety Disk-Shooting Toy" issued to Wu, and purports to be another example of a motor driven disk-discharging toy, although this device included light and sound effects.

In 2004, U.S. Pat. No. 6,733,356 for a "Flying-Object Launching Toy Gun" issued to Lee, and purports to disclose a toy gun for launching a propeller-like device from the gun using springs to provide launch energy and a rack and pinion to cause the propeller-like device to spin as it is launched. Lastly, U.S. Pat. No. 7,673,624 issued in 2010 for a "Disk Shooting Toy" issued in 2010 to Rosella Jr., and purports to disclose a toy for shooting disks using a spring plunger and a spin member, the distal end of a curved resilient arm.

These patents and devices are of some interest, however, they do not disclose or illustrate a superior marketable toy item.

SUMMARY OF THE INVENTION

In accordance with the present invention, an advantageous method and apparatus are provided in the form of a toy projectile launcher apparatus that discharges a soft foam circular projectile. The toy launcher is easily operated, even by young children, and requires a slide to be moved rearward to cock a launch spring, a projectile to be inserted and a lever to be pivoted. Pivoting the lever causes the slide and a projectile receptacle to snap forward in response to another spring such that the projectile is properly located to be contacted by a rotating launch arm once a trigger is pulled. The launcher apparatus also has the advantages of being relatively simple, easy to operate, fun to use, safe, relatively inexpensive, compact and yet, structurally robust.

Briefly summarized, the invention relates to a toy launcher apparatus for discharging circular projectiles including a housing assembly, a platform assembly mounted to the housing assembly, the platform assembly including a panel with a slot positioned to be spaced away from alignment with a center point of a loaded circular projectile, a cocking assembly connected to the platform assembly, the cocking assembly including a launch spring, a launch arm connected to the launch spring, a sliding structure, and a catch structure, the launch arm rotating in the slot when passing between a first uncocked position and a second cocked position and when the launch arm makes contact with a projectile disposed on the panel as the launch arm moves from the second position to the first position, the sliding structure being connected to the launch arm for moving the launch arm from the first position to the second position, and the catch structure engaging and maintaining the launch arm in the second position, and a trigger mounted to the housing assembly and connected to the catch structure to enable the catch structure to release the launch arm.

The invention also relates to a method for manufacturing the toy launcher apparatus including the steps of providing a housing assembly, attaching a platform assembly to the housing assembly, the platform assembly including a panel with a longitudinally directed slot positioned to be spaced away from alignment with a center point of a loaded circular projectile, attaching a cocking assembly to the platform assembly, providing a launch spring and a launch arm connected to the launch spring with the cocking assembly, rotating the launch arm in the slot when the launch arm passes between a first position and a second position, mounting a sliding structure for moving the launch arm from the first position to the second position, attaching a catch structure for engaging and maintaining the launch arm in the second position, and connecting a trigger to the catch structure to enable the catch structure to release the launch arm.

BRIEF DESCRIPTION OF THE DRAWINGS

For the purpose of facilitating an understanding of the invention, the accompanying drawings and detailed description illustrate preferred embodiments thereof, from which the invention, its structures, its construction and operation, its processes, and many related advantages may be readily understood and appreciated.

DESCRIPTION OF THE PREFERRED EMBODIMENT

Figure 1:
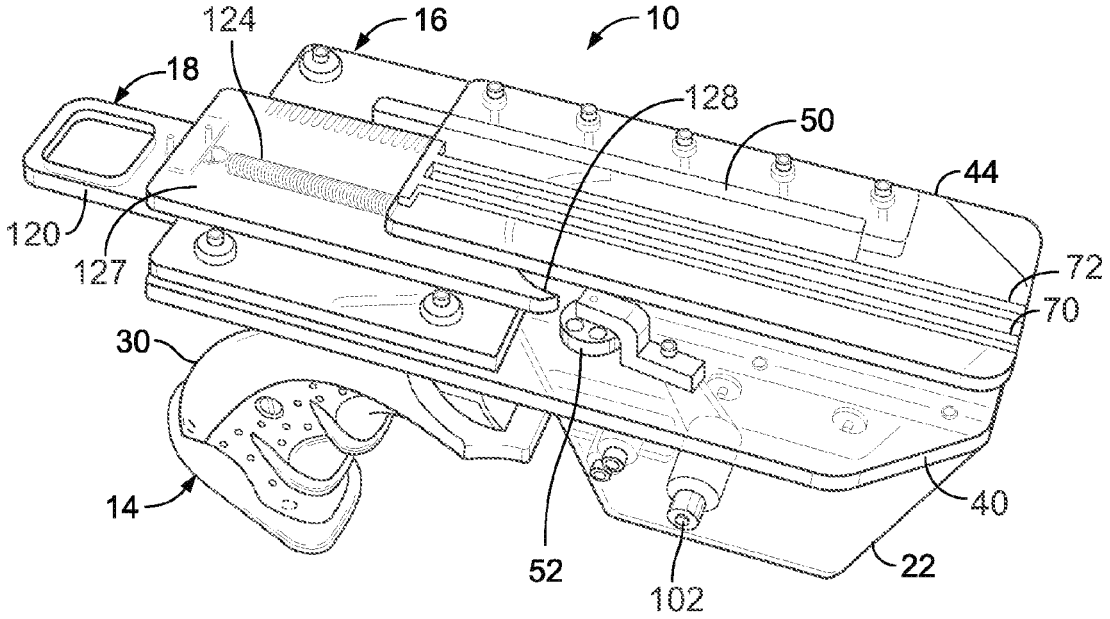
FIG. 1 is a downward looking isometric view of a preferred embodiment of the present invention in the form of a toy projectile launcher apparatus.

The following description is provided to enable those skilled in the art to make and use the described embodiments set forth in the best mode contemplated for carrying out the invention. Various modifications, equivalents, variations, and alternatives, however, will remain readily apparent to those skilled in the art. Any and all such modifications, variations, equivalents, and alternatives are intended to fall within the spirit and scope of the present invention.

Referring now to FIGS. 1-5, there is shown an embodiment of the invention in the form of a toy projectile launcher apparatus 10 for discharging circular projectiles provided in the form of an aerodynamic flying disc or a toy projectile having a soft exterior and a more robust interior, somewhat similar to discs commonly referred to as Frisbees, one such projectile 12 being shown in FIGS. 6, 7 and 9-12. The toy projectile is structured to be discharged from a toy launcher apparatus with discharge energy imparted to the toy projectile through a brief, but sharp impact at a relatively small contact area at the toy projectile generating good flight characteristics and distance. The toy launcher apparatus includes a housing assembly 14, a platform assembly 16, a cocking assembly 18, a trigger 20 and side support panels 22, 24. The platform assembly, part of the cocking assembly and the support panels as formed of clear plastic to better illustrate internal mechanisms of the launcher apparatus 10. In the alternative, non-clear plastic and different shapes may be used if found desirable as exemplified by the embodiment shown in FIG. 14.

The housing assembly 14 includes a gun-like grip 30 to enable a user to hold the toy projectile launcher apparatus while easily cocking the apparatus, and loading, positioning and discharging the projectile. The housing assembly 14 acts as a base for the platform assembly 16, the cocking assembly 18, the trigger 20 and the side support panels 22 and 24. The trigger 20 is located in the conventional location for ease of use.

The platform assembly 16 includes a horizontally disposed lower panel or launch deck 40 having a top surface 42, and an upper panel or disc ceiling 44 positioned parallel to, but spaced from the lower panel 40 at a predetermined distance approximately equal to the height of the projectile 12, and having a bottom surface 46. The platform assembly also includes a longitudinal guide wall 50 mounted to the launch deck 40, a positioning wheel or limit structure 52 also mounted to the launch deck 40, and support rollers 54, 56, 58 connected to the support panels 22, 24 for supporting part of the cocking assembly. Connected to and depending from the launch deck 40 are the side support panels 22, 24. The launch deck 40 includes a longitudinal slot 60, running parallel to the guide wall 50, with the longitudinal slot 60 being positioned in the launch deck out of alignment with a center point of the projectile 12 as will be explained in more detail below. The bottom surface 46 of the upper panel 44 and the top surface 42 of the launch deck 40 each include friction reducing guide rails, a pair of guide rails 70, 72, FIG. 4, on the bottom surface 46 and three guide rails 74, 76, 78 on the top surface 42. The rails provide low friction guides for a positioning and discharging projectile and the rails prevent the projectile from moving upward in response to a discharge force.

Figure 6:
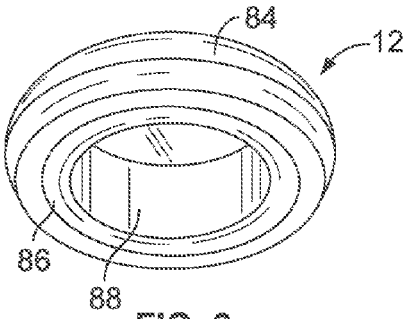
FIG. 6 is an upward looking isometric view of a toy projectile of the type that may be discharged by the toy launcher apparatus shown in FIGS. 1-5.
Figure 7:
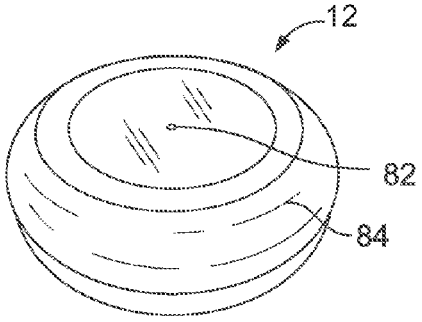
FIG. 7 is a downward looking isometric view of the toy projectile shown in FIG. 6.

The circular projectile 12, FIGS. 6 and 7, has a circular plan view configuration, with a center point 82, FIG. 7, an outer covering 84 of soft material, such as that sold under the brand NERF™, and an inner core 86 of a more robust material, all as disclosed in a companion patent application (attorney docket 1-360). The outer covering 84 is generally donut shaped with an open center and the inner core 86 is generally cup shaped and positioned in the open center so that the top of the projectile is closed, as shown in FIG. 7, and the bottom is opened, as shown in FIG. 6. Bordering the open bottom is an annular inner wall 88 of the inner core 86. Aerodynamically the projectile 12 acts similarly to a Frisbee in that the projectile has, when launched, a direction of flight or travel as well as a rotational spin. As will be explained in more detail below, when launched, the "off center" location of the launcher slot 60 relative to the center point 82 of the projectile allows the projectile to be engaged by a launch arm so such that a component of force is directed parallel to the slot in the direction of projectile travel, and a component force acts perpendicular to the slot to enable a spin to be engendered when the projectile is launched.

Figure 2:
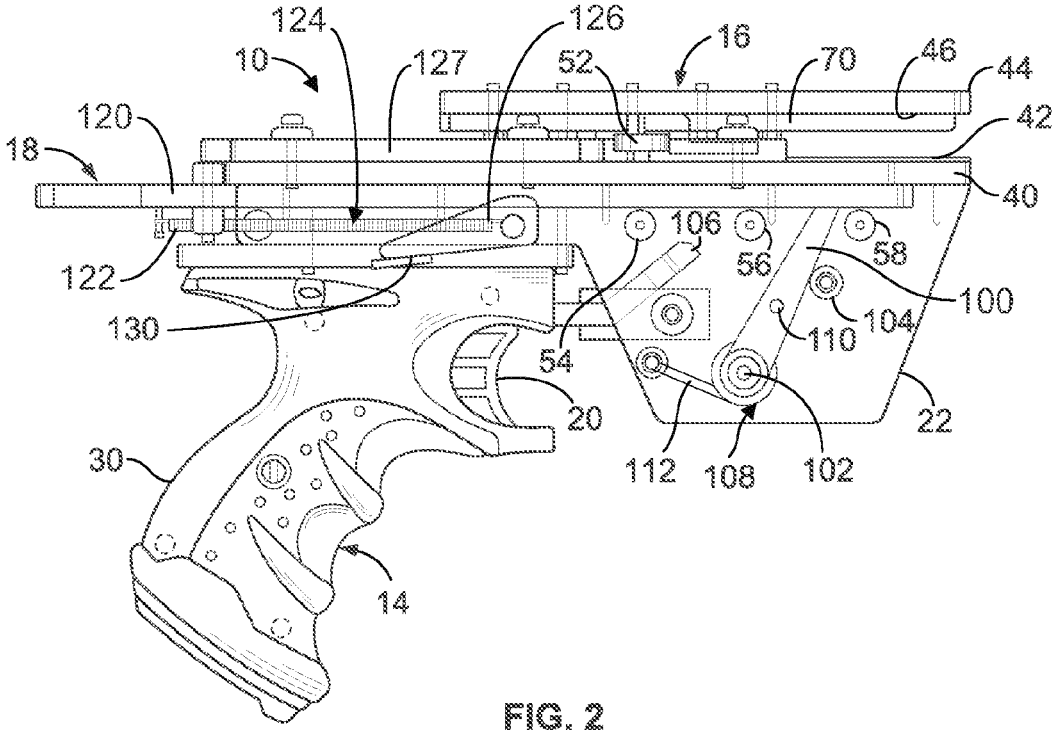
FIG. 2 is a right side elevation view of the toy projectile launcher apparatus shown in FIG. 1.
Figure 3:
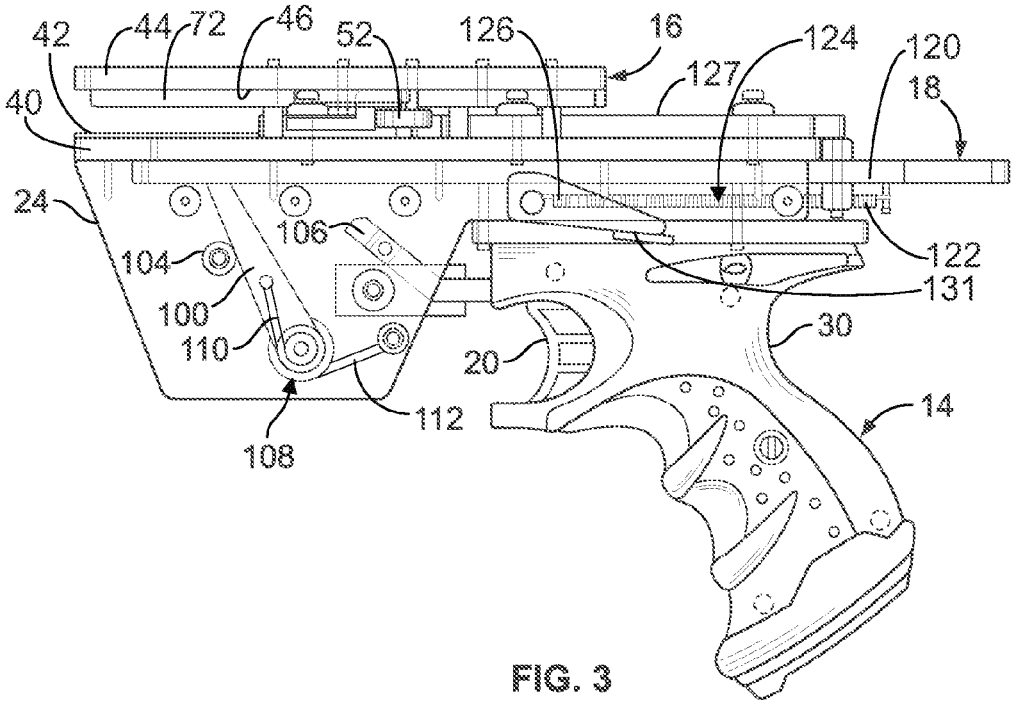
FIG. 3 is a left side elevation view of the toy projectile launcher apparatus shown in FIGS. 1 and 2.
Figure 11:
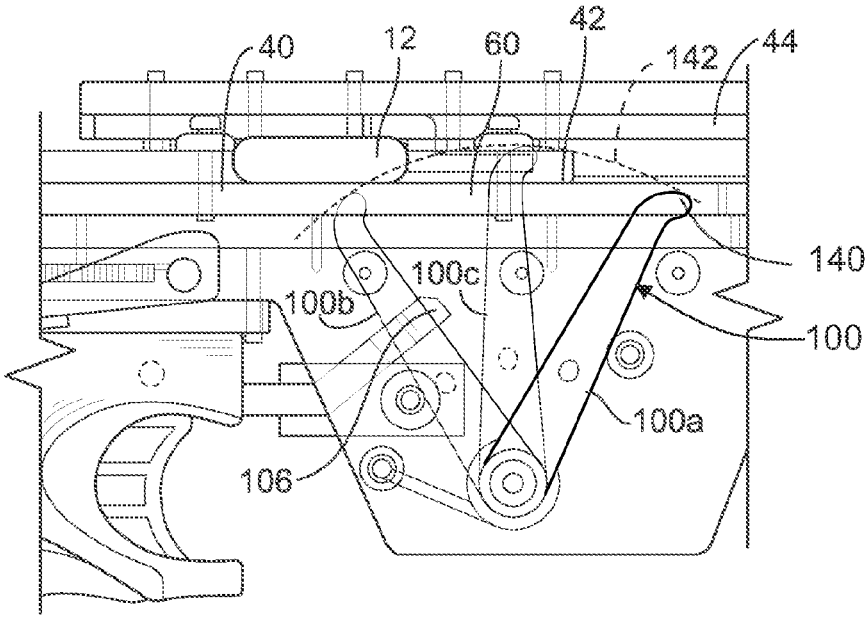
FIG. 11 is an enlarged, partial diagrammatic elevation view, similar to the view shown in FIG. 2, but with a launch arm moving between an uncocked position and a cocked position.

The cocking assembly 18 includes a launch arm 100, FIGS. 2, 3 and 11, that is connected to the side panels 22, 24 at a pivot 102 so that the launch arm is rotatable about the pivot 102 between two positions, a first or uncocked forward position shown in FIGS. 2 and 11 adjacent a cushioned bumper 104, and designated 100*a*, in FIG. 11, and a second or cocked rearward position also shown in FIG. 11, in dotted line and designated 100*b*, where the launch arm is captured by a catch structure 106. An intermediate position of the launch arm is also shown in dotted line in FIG. 11, and designated 100*c*, between the forward and rearward positions. The cocking assembly 18 also includes a torsion spring 108 mounted to the pivot 102 and to the support panels 22, 24 for causing the launch arm 100 to snap from the rearward cocked position to the forward position when the user squeezes the trigger 20. One arm 110 of the spring is connected to the launch arm 100 and is movable with the launch arm, and a second arm 112 of the spring is fixed to the support panels. When the launch arm 100 is moved rearward to the cocked position, the torsion spring 108 is loaded, and when released, provides a launching force or energy to the launch arm, and from the launch arm to the projectile, to cause discharge of the projectile.

The cocking assembly includes, in addition, a sliding structure or cocking slide 120 mounted beneath the lower panel or launch deck 40 and connected to the launch arm 100. The cocking slide 120 may be moved by the user from a first, at rest position shown in FIGS. 1-3 and 5, and a second, cocking position shown in FIG. 8. Attached to the cocking slide 120 is one end 122 of a slide spring 124 with the other end 126 connected to one or both of the side panels 22, 24. Movable with the cocking slide is a projectile carriage 127 that includes a projectile receptacle 128 to receive a projectile as shown in FIG. 9. Pulling the cocking slide 120 to the second position causes the slide spring 124 to stretch and create a biasing force to return the cocking slide and a loaded projectile carriage to a predetermined projectile discharge position, as shown in FIG. 10, when the slide and the carriage are released by the user. In the second position the cocking slide engages a ramp that captures and maintains the cocking slide in the rearward position until the user causes release. Simultaneously, when the cocking slide 120 is pulled rearward to the cocked position, the connected launch arm 100 is rotated to its second, cocked position where the catch structure 106 captures the launch arm 100, as shown in FIG. 11, until released by a user squeezing the trigger 20.

In addition to the launch arm 100, the catch structure 106, the cocking slide 120, the projectile carriage 127, and the slide spring 124, the cocking assembly includes release levers 130, 131, one lever on each side of the launcher apparatus as shown in FIGS. 2 and 3. The cocking slide 120 is connected to the release levers 130, 131 so that when either lever is activated, the projectile carriage 127 with the loaded projectile 12 and the slide 120 are caused to snap forward to the discharge position where the projectile is positioned against the guide wall 50 and the positioning wheel 52, as shown in FIG. 10.

The launch arm 100 includes a distal or extended end portion 140, FIG. 11, shaped like a rounded hammer, which is movable in an arc 142 shown in dotted lines as the launch arm travels between the uncocked forward position shown in solid lines and labeled 100*a*, and the cocked rearward position of the launch arm shown in phantom lines and labeled 100*b*, where the launch arm 100 is captured by the catch structure 106. An intermediate position of the launch arm 100 is shown in FIG. 11 and labeled 100*c*, between the forward and rearward positions. The vertical position of the launch arm 100*c* represents the most extended position of the launch arm above the top surface 42 of the bottom panel or launch deck 40. The movement of the launch arm end portion 140 is located in the slot 60 of the launch deck 40 and is represented by the arc 142. The arm end portion 140 extends below the top surface 42 of the launch deck 40 at opposite end portions of the arc when the launch arm is in the uncocked and cocked positions as represented by the launch arms designated 100*a* and 100*b*, such that no intersection with the projectile is possible. In the middle portion of the arc (exemplified by the intermediate position of the launch arm 100*c*) the launch arm is above the top surface 42 of the launch deck 40 and contact with the projectile will take place.

When the launch arm end portion 140 moves rapidly above the top surface 42 of the launch deck 40, engagement is made between the launch arm 100 and the toy projectile annular inner wall 88 and energy is transferred from the launch arm 100 to the toy projectile 12 to accelerate the toy projectile between the rails 70, 72, 74, 76, 78 in the upper and lower panels 40, 44. Because the slot 60 in the launch deck 40 is misaligned relative to the center point 82 of the toy projectile (shown off center in an exaggerated fashion in FIG. 12), the impact force of the launch arm includes a main component of force 150, FIG. 12, directed parallel to the direction of travel of the projectile along the longitudinal axis of the toy launcher apparatus and parallel to the guide wall 50 and the slot 60, and a secondary component of force 152 directed normal to the direction of travel.

Figure 4:
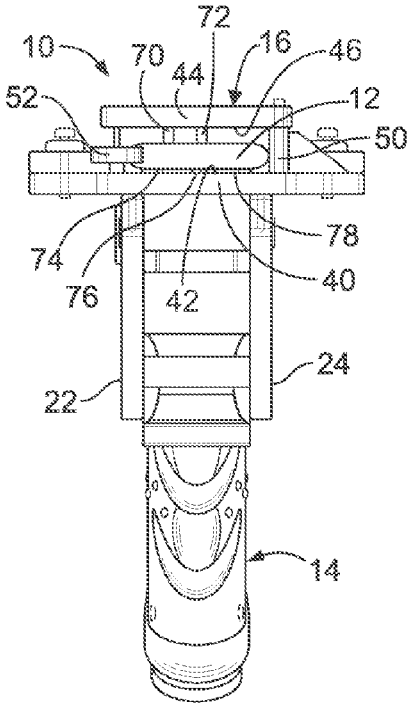
FIG. 4 is a front elevation view of the toy projectile launcher apparatus shown in FIGS. 1-3.
Figure 5:
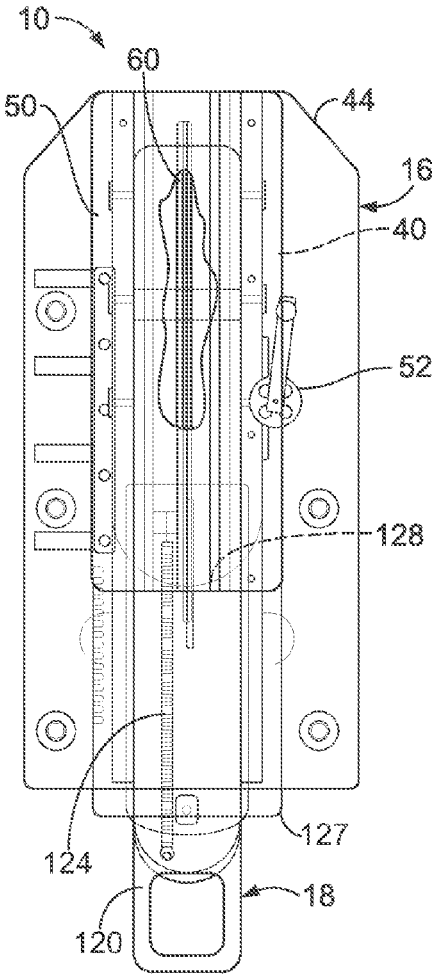
FIG. 5 is a top plan view, partially broken away, of the toy projectile launcher apparatus shown in FIGS. 1-4.
Figure 8:
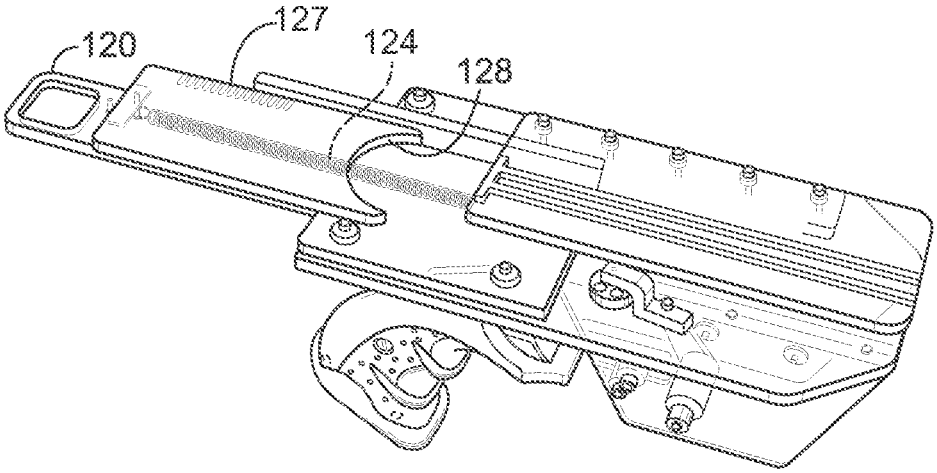
FIG. 8 is a reduced downward looking isometric view of the toy projectile launcher apparatus illustrated in FIGS. 1-5, but in a cocked position.
Figure 9:
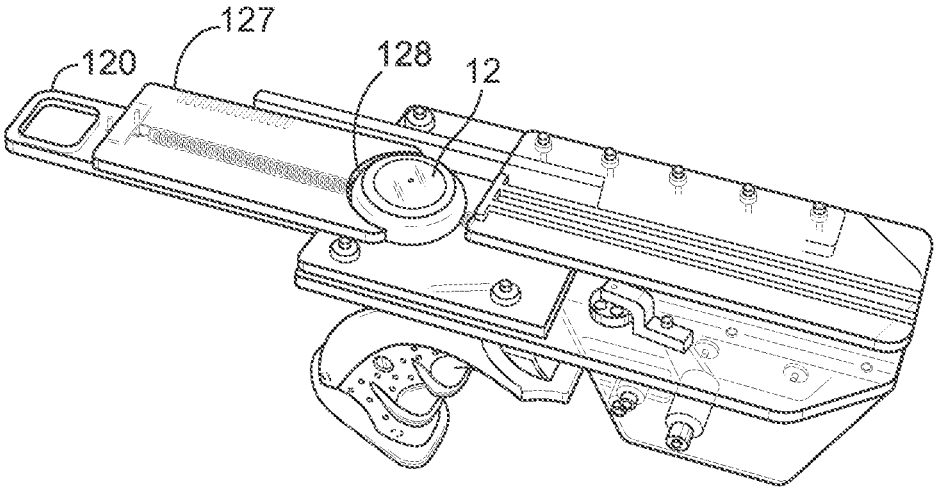
FIG. 9 is a downward looking isometric view of the toy projectile launcher apparatus illustrated in FIG. 8, but with a toy projectile in a loaded position.
Figure 10:
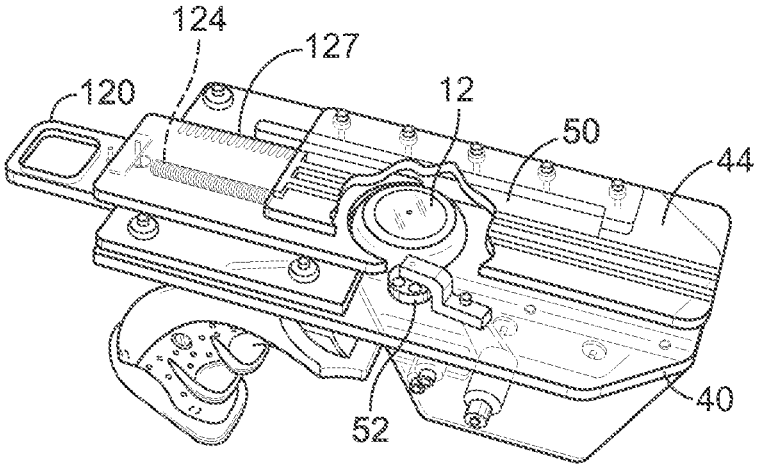
FIG. 10 is a downward looking isometric view of the toy projectile launcher apparatus, partially broken away, as illustrated in FIGS. 8 and 9, but with the toy projectile in position for discharge.
Figure 12:
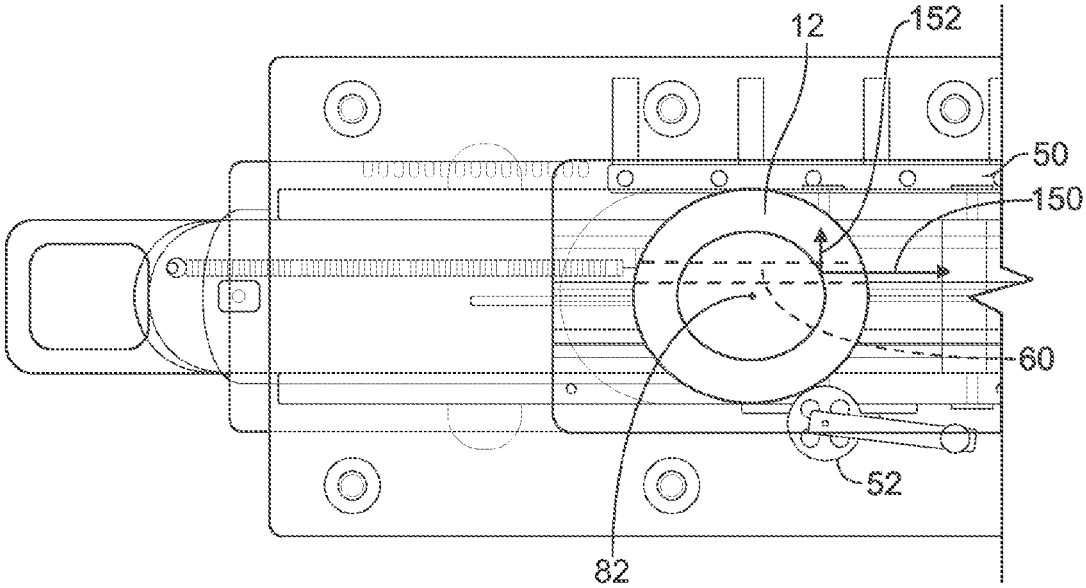
FIG. 12 is an enlarged, partial diagrammatic top plan view, similar to the view shown in FIG. 5, but illustrating force components acting on a toy projectile caused by impact of the launch arm.

Referring now to FIGS. 8-10, cocking, loading and positioning of the toy projectile is illustrated. In FIG. 8, the cocking slide 120 is illustrated after being pulled rearward by the user to tension the torsion spring 108 and the slide spring 124. In FIG. 9, the toy projectile 12 has been loaded in the projectile receptacle 128. After the release lever 130 is activated, the slide spring 124 rapidly moves the cocking slide 120, the carriage 127 and the loaded toy projectile into a discharge position illustrated in FIG. 10. In the discharge position the toy projectile 12 has moved forward and bears against the guide wall 50 on one side and against the positioning wheel 52 on the opposite side, as illustrated in FIGS. 4, 10 and 12. A combination of the toy projectile bearing against the guide wall 50 caused by the force component 152 and the position of the wheel 52, creates a friction force and causes, upon discharge, the projectile to spin and thereby improve flight characteristics. It is noted that at the start of discharge the toy projectile must "squeeze" past the wheel 52. The squeeze insures that the projectile 12 will bear against the guide wall 50 inducing friction and causing the desired spin.

It is noted that throughout this disclosure, words such as "forward", "rearward", "upper", "lower", "top", "bottom", "front", "rear", "above" and "below", as well as like terms, refer to portions of the toy launcher apparatus as they are viewed in the drawings relative to other portions or in relationship to the positions of the apparatus as it will typically be held and moved during play when operated by a user.

The trigger 20 is mounted to the housing assembly 12, is spring loaded, and is connected to the catch structure 106. When pulled by the user after the user has cocked the toy launcher apparatus, the trigger moves the catch structure sufficiently to cause the launch arm 100 to be released, allowing the launch arm to rotate rapidly under the influence of the torsion spring 108 and impact upon the toy projectile as best illustrated in FIG. 11.

Figure 14:
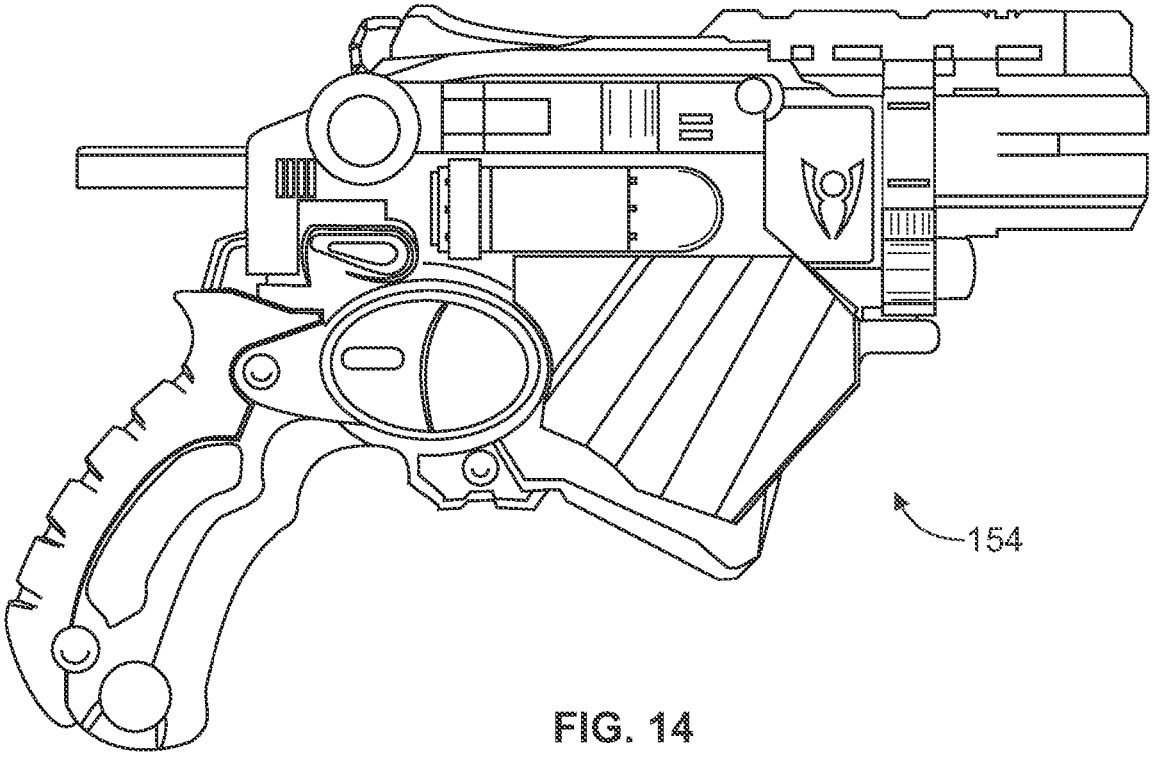
FIG. 14 is a right side elevation of another preferred embodiment of the present invention illustrating a different outer configuration from that shown in FIGS. 1-5.

The toy launcher apparatus may include, in the alternative, a projectile magazine, a cartridge, a cassette or a canister loaded with multiple projectiles to load projectiles into the receptacle. Also in the alternative, the launch arm may have a peripheral notch that a pivoting catch structure may engage to capture the launch arm in a cocked position. Another alternative may dispense with the cocking slide moving the launch arm. Instead, a cocking lever may be used or a user may directly retract the launch arm with his/her hand to its cocked position. The housing assembly may have a different design and the platform assembly may be covered or modeled after a real weapon and/or have indicia of a popular merchandising concept. One such variation toy launcher apparatus 154 is shown in FIG. 14. Also, it should be noted that the various structures described above which have been grouped as part of assemblies, may be treated individually without regard to an "assembly", or the structures may be grouped in smaller assemblies or subassemblies. The use of assemblies here is strictly for convenience and clarity.

In operation, the toy projectile launcher apparatus is held by one hand of a user using the pistol grip. The cocking slide is gripped with the other hand and pulled rearward until both the launch arm and the cocking slide are captured in their rearward positions. At the same time the carriage with the projectile receptacle, being connected to the cocking slide, is also moved rearward to expose the receptacle and allow a user to insert a circular projectile. Thereafter, one of the release levers may be moved downward to release the slide and the carriage so as to have them move forward under the influence of the stretched slide spring. This forward movement properly locates the loaded projectile in a forward position against both the positioning wheel and the guide wall, and places the projectile in position to be engaged by the launch arm once the user pulls the trigger. Once the launch arm is released and moves along the arc, the loaded projectile is impacted to cause the projectile to be discharged with a spin.

Figure 13:
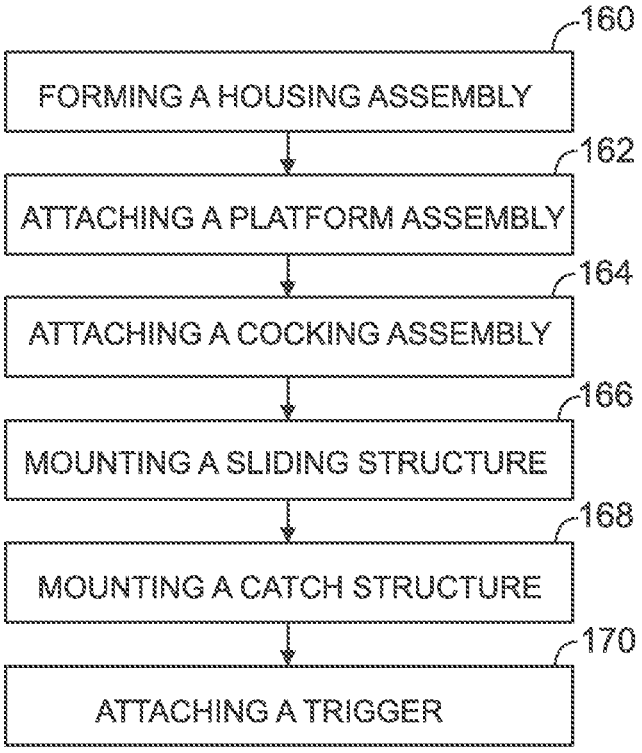
FIG. 13 is a flow diagram for a method of manufacturing the toy projectile launcher apparatus illustrated in FIGS. 1-5.

The present invention also includes a method for manufacturing a toy launcher apparatus capable of discharging circular projectiles, the steps including forming 160, FIG. 13, a housing assembly, attaching 162 a platform assembly to the housing assembly, the platform assembly including a panel with a slot positioned to be spaced away from alignment with a center point of a loaded circular projectile, attaching 164 a cocking assembly to the platform assembly, the cocking assembly including a launching spring, a launch arm, and a carriage, the launch arm being connected to the torsion spring, the launch arm being movable in the slot when passing between first uncocked position and second cocked positions, mounting 166 a sliding structure and a slide spring, the sliding structure being connected to the launch arm for moving the launch arm from the first uncocked position to the second cocked position, and the carriage and slide spring for moving a loaded projectile to a predetermined discharge position, mounting 168 a catch structure and a release lever, the catch structure for engaging the launch arm to maintain the launch arm in the cocked position, and the release lever being connected to the sliding structure for causing the sliding structure and the carriage to return to an uncocked position, and attaching 170 a trigger to the housing assembly, the trigger being connected to the catch structure to enable the catch structure to release the launch arm allowing the launch arm to snap back to the first uncocked position.

The toy launcher apparatus disclosed in detail above has great play value, is fun to use and easy to operate in a safe manner, even for young children, and yet the launcher apparatus has a robust, but simple structure, that may be produced at a reasonable cost.

From the foregoing, it can be seen that there has been provided features for an improved toy launcher apparatus and a disclosure for the method of the making the toy. While a particular embodiment of the present invention have been shown and described in detail, it will be obvious to those skilled in the art that changes and modifications may be made without departing from the invention in its broader aspects. Therefore, the aim is to cover all such changes and modifications as fall within the true spirit and scope of the invention. The matters set forth in the foregoing description and accompanying drawings are offered by way of illustrations only and not as limitations. The actual scope of the invention is to be defined by the subsequent claims when viewed in their proper perspective based on the prior art.

What is claimed is:

1. A projectile and toy launcher combination comprising:

a housing assembly;

a projectile having an exterior, a closed top, an open bottom and a wall within and around the open bottom, the projectile receivable by the housing assembly;

a cocking assembly including a rotatable launch arm and a launch spring, the launch arm being movable between a lowered position disengaged from the projectile and a raised position for engaging the projectile, wherein the projectile is located in the housing assembly to enable the launch arm in moving from the lowered position to the raised position to pass through the open bottom of the projectile to engage the inner wall, the cocking assembly mounted to the housing assembly; and a trigger assembly for releasing the launch spring, the trigger assembly mounted to the housing assembly.

2. The projectile and toy launcher combination of claim 1, wherein:

the launch arm is pivotally connected within the housing assembly beneath the open bottom of the projectile, after the projectile is received by the housing assembly.

3. A projectile and toy launcher combination comprising:

a housing assembly;

a projectile including a soft exterior, a closed top, an open bottom and an interior hard wall within and surrounding the open bottom;

the projectile for mounting to the housing assembly;

a cocking assembly including a launch arm and a launch spring;

the cocking assembly connected to the housing assembly with the launch spring for rotating the launch arm to a raised position to engage the hard wall within the open bottom of the projectile; and a trigger assembly mounted to the housing assembly for releasing the launch spring to enable the launch arm to rotate to the raised position and discharge the projectile from the housing assembly.

4. The projectile and toy launcher combination of claim 3, including:

a launch deck within the housing assembly for receiving and locating the projectile above the launch arm to enable the launch arm to engage the projectile through the open bottom.

5. The projectile and toy launcher combination of claim 4, including:

a slot formed in the launch deck; and wherein the launch arm rotates through the slot.

6. The projectile and toy launcher combination of claim 5, wherein:

the launch deck includes a length and a center;

the slot extends along a portion of the length of the launch deck; and the slot is off-set from the center of the launch deck.

7. The projectile and toy launcher combination of claim 6, including:

a first structure for positioning the projectile on the launch deck over the slot.

8. The projectile and toy launcher combination of claim 7, including:

a second structure for limiting movement of the projectile during positioning.

9. A projectile and toy launcher combination comprising:

a housing assembly;

a projectile having a soft exterior, a closed top, an open bottom and a hard wall surrounding the open bottom, the projectile for being located in the housing assembly;

a cocking assembly including a rotatable launch arm and a launch spring, the launch spring enabling the launch arm to engage the hard wall of the projectile through the open bottom for causing the projectile to be discharged from the housing assembly, the cocking assembly connected to the housing assembly and a trigger assembly mounted to the housing assembly to release the launch spring.

10. The projectile and toy launcher combination of claim 9, including:

structure within the housing assembly for receiving and locating the projectile to enable the launch arm to engage the projectile through the open bottom.

11. The projectile and toy launcher combination of claim 9, including:

a slot formed in a launch deck to enable movement of the launch arm.

12. The projectile and toy launcher combination of claim 9, wherein:

the launch arm moves between lowered and raised positions wherein in the lowered position the launch arm is disengaged from the projectile and in the raised position the launch arm engages the projectile.

13. The projectile and toy launcher combination of claim 9, including:

a first structure for positioning the projectile.

14. The projectile and toy launcher combination of claim 13, including:

a second structure for limiting movement of the projectile during positioning.

15. The projectile and toy launcher combination of claim 9, including:

a launch deck within the housing assembly for receiving and locating the projectile to enable the launch arm to engage the projectile through the open bottom; and a slot formed in the launch deck to enable movement of the launch arm.

16. The projectile and toy launcher combination of claim 9, wherein:

the launch arm moves between lowered and raised positions.

17. The projectile and toy launcher combination of claim 9, wherein:

the launch arm moves between lowered and raised positions; and including a first structure for positioning the projectile.

18. The projectile and toy launcher combination of claim 17, including:

a second structure for limiting movement of the projectile during positioning of the projectile.

19. The projectile and toy launcher combination of claim 18, wherein:

the first structure positions the projectile to enable the launch arm to engage the projectile through the open bottom.

20. The projectile and toy launcher combination of claim 19, including:

a launch deck within the housing assembly for receiving and locating the projectile to enable the launch arm to engage the projectile through the open bottom; and a slot formed in the launch deck to enable movement of the launch arm.

* * * * *